United States Patent [19]

Schwartz et al.

[11] Patent Number: 4,469,024

[45] Date of Patent: Sep. 4, 1984

[54] FLUID DISPENSING APPARATUS SUCH AS SPRAY DAMPENER FOR PRINTING PRESS AND METHOD OF DISPENSING

[75] Inventors: Michael A. Schwartz; Toshio Yamagata, both of Batavia, Ill.

[73] Assignee: Press Machinery Corporation, Bensenville, Ill.

[21] Appl. No.: 434,875

[22] Filed: Oct. 18, 1982

[51] Int. Cl.[3] ..... B41F 7/24

[52] U.S. Cl. ..... 101/147; 101/366

[58] Field of Search ..... 101/148, 366, 147; 118/70, 259

[56] References Cited

U.S. PATENT DOCUMENTS

| | | | |
|---|---|---|---|
| 2,347,619 | 4/1944 | Taylor et al. | 101/148 X |
| 2,389,730 | 11/1945 | Iler | 101/147 |
| 3,541,959 | 11/1970 | Taffel et al. | 101/365 X |
| 3,608,483 | 9/1971 | Kaminstein | 101/148 |
| 3,702,587 | 11/1972 | Lee | 101/365 X |
| 3,926,115 | 12/1975 | Alsop | 101/148 |
| 4,044,673 | 8/1977 | Junghams | 101/148 |
| 4,064,801 | 12/1977 | Switall | 101/147 |

*Primary Examiner*—Edgar S. Burr
*Assistant Examiner*—John A. Weresh
*Attorney, Agent, or Firm*—Allegretti, Newitt, Witcoff & McAndrews, Ltd.

[57] ABSTRACT

A fluid dispensing apparatus such as a spray dampener sprays fluid on the rollers of a printing press. The spray is regulated by an automatic controller which pulses the spray at time intervals related to the signal of a press speed sensor. Fluid pressure controls and orifice configuration controls are eliminated; fluid pressure and orifice size are fixed.

2 Claims, 9 Drawing Figures

FLUID DISPENSING APPARATUS SUCH AS SPRAY DAMPENER FOR PRINTING PRESS AND METHOD OF DISPENSING

BACKGROUND OF THE INVENTION

This invention relates to printing presses, and more particularly, to an apparatus, such as a spray dampener, for dispensing fluid to a roller of a printing press.

In the printing art, and especially the modern newspaper printing art, various devices and systems have been disclosed for applying a fluid to the rollers of printing presses, to accomplish dampening, cleaning, the prevention of offset and the like. The art as presently practiced includes such time-honored devices as open, fluid filled troughs for bathing rollers and such modern devices as spray dampeners which dampen rollers by fluid mist sprayed from nozzles positioned alongside the rollers at spaced mounting positions along frame members called spray bars.

Spraying devices offer many advantages over troughs, such as easier maintenance and greater consistency in fluid application. All such spraying devices presently known have some common features. First, the devices use air as a medium for the spraying of the desired fluids, to atomize the fluids and thereby provide a desirably even and light spray. Second, all such devices control and vary spray quantity by regulating fluid pressure and/or the configurations of the nozzle openings or orifices. Spray quantity is varied to provide an application of fluid to the roller which increases or decreases in quantity relative to press operation factors, such as press speed. An example of a spray dampening device is found in U.S. Pat. No. 4,064,801.

While the mentioned fluid application devices have proven somewhat desirable, they have consistently yielded to several long-standing problems. As a first example, they have experienced frequent failures, and high maintenance demands due to nozzle clogging. This problem has generally been caused by the air/fluid spray nozzles plugging due to ink mist, paper dust and water deposits. The plugging deforms or eliminates spray patterns, starving roller areas of needed fluid. As a second example, they have experienced frequent failures and high maintenance requirements due to inconsistences in their metering devices. Metering pumps have frequently malfunctioned from debris and leaking seals. Metering orifices have become uncalibrated from vibration. As a third example, they have required cumbersome controls, which occupy valuable operator space on the presses.

SUMMARY OF THE INVENTION

Given the foregoing state of the art, an object of this invention is to provide an improved fluid dispensing apparatus for a printing press.

Another object is to provide a fluid dispensing apparatus for dispensing fluid to a roller of a printing press which provides fluid to the roller in quantities varying with press speed.

Another object is to provide apparatus as described which is significantly free of the malfunction and breakdown problems of prior devices.

These and other objects and advantages are provided by the invention, which proceeds from a profound reexamination of the assumptions underlying prior art devices, and a significant discovery as to printing press operation in the context of spray dampening. As known to the applicants, all prior art spray dampening devices have adjusted or metered spray quantity through variations of spray fluid pressure or nozzle orifices on the routine assumption that uninterrupted spray was mandatory at operational press speeds. In a principal aspect, this invention teaches that uninterrupted spray is not mandatory, and that in fact, interrupted spray at operational press speeds is not only possible but desirable. The applicants have discovered that in the context of spray dampening, fluid from a spray directed at a roller accumulates at the roller nip in sufficient quantities that spray may be interrupted without dry spots, or even significant variation in roller wetting. Spray interruption is possible because until fluid accumulation at the nip is depleted, the fluid accumulated at the nip spreads across any unsprayed areas of the roller. As a result, the fluid spray may be switched on and off. The quantity of fluid applied to the roller per unit time is then related to the relative time intervals of the on and off cycles. For example, as the time intervals during which the spray is on increase relative to the time intervals during which the spray is off the quantity of fluid applied to the roller per unit time increases.

Thus, in a principal aspect, this invention is a fluid dispensing apparatus for dispensing fluid to a roller of a printing press. The apparatus comprises sensing means, spraying means, mounting means and controlling means. The sensing means constitutes means for sensing a speed of the printing press and for generating a signal related to the speed. The spraying means constitutes means for spraying the fluid on the roller and thereby dispensing the fluid to the roller. The spraying means includes at least one orifice and is operable in two states of operation. The first state is for spraying the fluid.

The mounting means is for mounting the sensing means in proximity to the printing press and mounting the spraying means in proximity to the roller.

The controlling means is for controlling the spraying means in relation to the signal. The controlling means switches the spraying means between the first and second states of operation, and performs such switching at time intervals related to the signal, and thereby related to the press speed. As a result, control of the spraying means through variation of fluid pressure and/or orifice configuration may be eliminated. The quantity of fluid applied to the roller may, in contrast, be determined solely by the relative lengths of the time of operation in the first and second states of operation.

BRIEF DESCRIPTION OF THE DRAWING

The drawing consists of seven figures, briefly described as follows.

DETAILED DESCRIPTION OF THE PREFERRED EMBODIMENT

Figure 1:
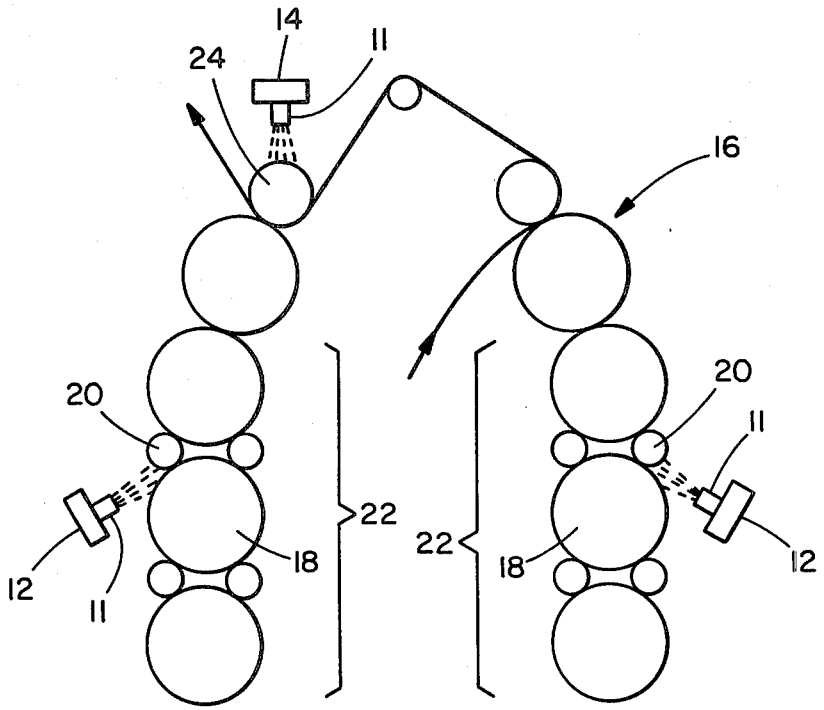
FIG. 1 is a diagrammatic view of a press unit for which the apparatus of the invention is suited.
Figure 2:
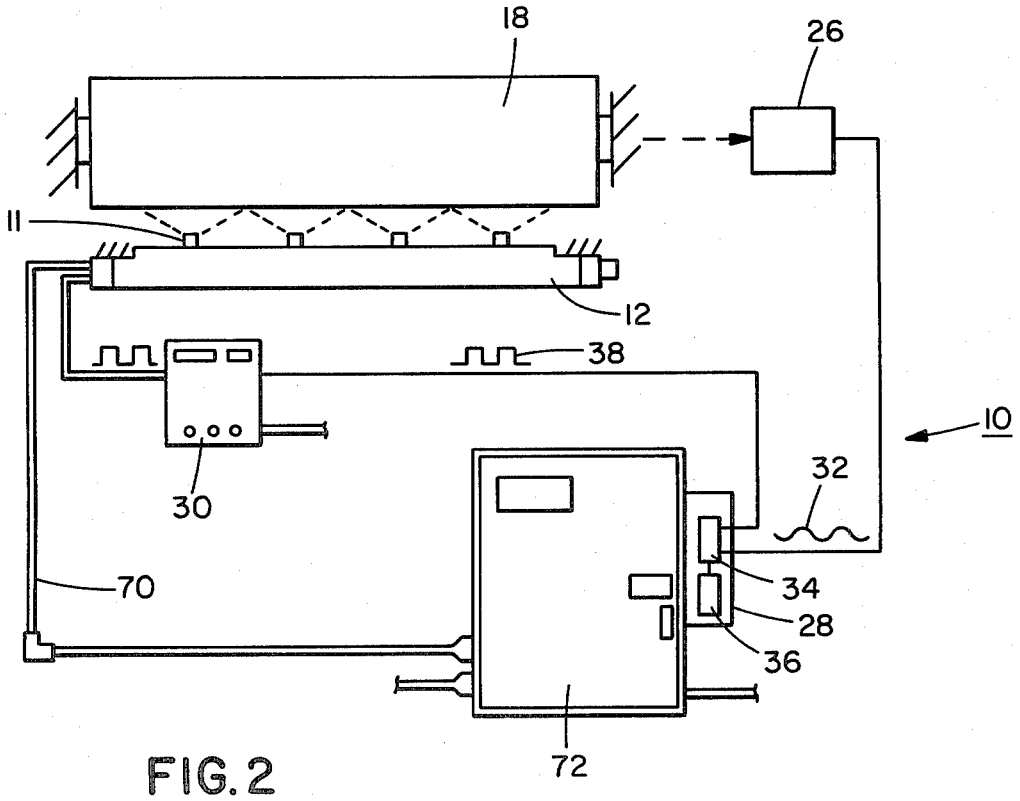
FIG. 2 is a diagrammatic view of the apparatus of the preferred embodiment of the invention.
Figure 3:
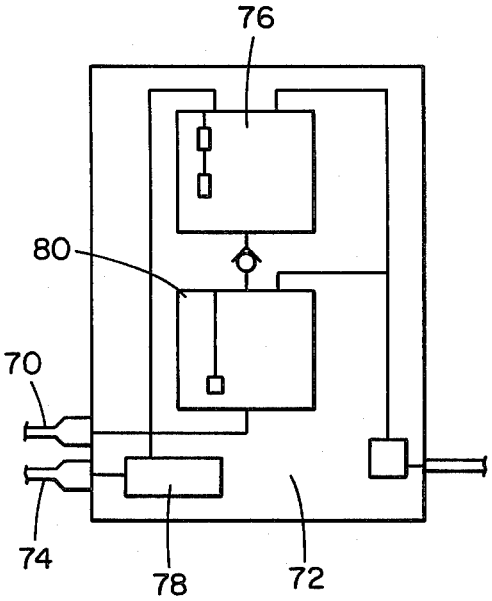
FIG. 3 is a diagrammatic view of the mixing cabinet of the preferred embodiment.

Referring to FIGS. 1 and 2 of the accompanying drawing, the preferred embodiment of this invention is a fluid dispensing apparatus 10 which includes one or more means for spraying a fluid on a roller such as nozzles 11, and one or more associated mounting means such as a spray dampener spray bar assembly 12 or an anti-offset spray bar assembly 14. The apparatus 10 may be used in a variety of lithographic printing units in the newspaper and other printing industries. Such units include, by example, a one-color or black offset printing press 16. As desired, spray may be directed upward from the spray dampener spray bar assembly 12 toward the ink drums 18 and ink form rolls 20 of ink trains 22, downward from the anti-offset spray bar assembly 14 toward an impression roller 24, or at any desired angle toward any desired roller. (It should be understood that in the claims, the term "roller" does not exclude, but includes, printing press elements such as drums and rolls.)

While any number of spraying means and mounting means such as the nozzles 11 and bars 12, 14 may be elements of the apparatus 10, one spray bar 12 with four nozzles 11 is illustrated in FIG. 2, for ease of description. With these components, the apparatus 10 further comprises a sensing means such as a sensor 26, and a controlling means such as a programmable controller 28 and unit controller 30.

The sensor 26 may be a tachometer, proximity sensor or the like. It is positioned in proximity to the roller 18 of the printing press unit 16, and senses or measures the rotary speed of the roller 18. In response, the sensor 26 generates a sensor signal such as the sinusoidal electrical signal 32, which is related to the roller speed.

Figure 4:
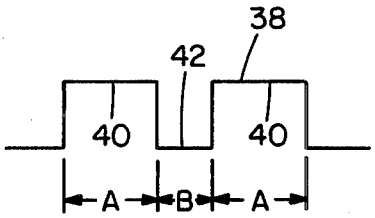
FIG. 4 is a graph of the signal 38 of the controller 28.
Figure 5:
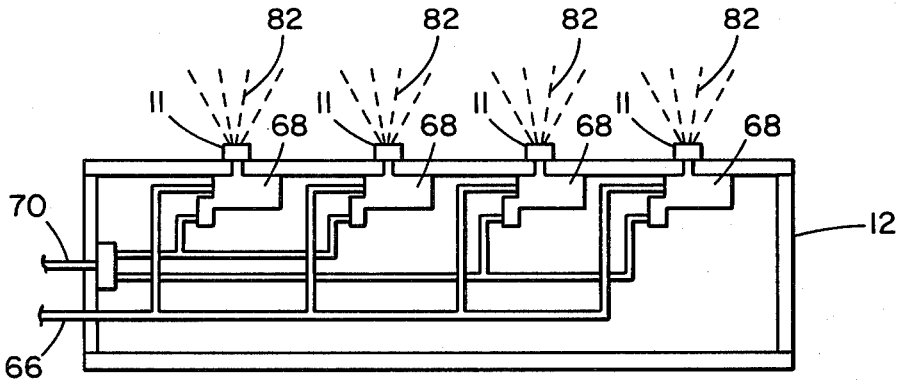
FIG. 5 is a view of the internal components of the spray bar 12 of the preferred embodiment.

The controller 28, which functions as a pulse width modulator, receives the sensor signal 32 at an electronic processor 34. A time constant clock signal is also received by the processor 34 from a clock 36 within the controller 28. As with a pulse width modulator, the processor 34 generates a pulsed control signal, which, as in FIG. 4, consists of signal segments 40 having a first signal value interrupted by signal segments 42 of a second signal value. The widths, or time intervals, of one or both of segments 40, 42, which are respectively designated A and B, are caused by the processor 34 to vary in relation to the frequency of the signal 32.

Figure 7A:
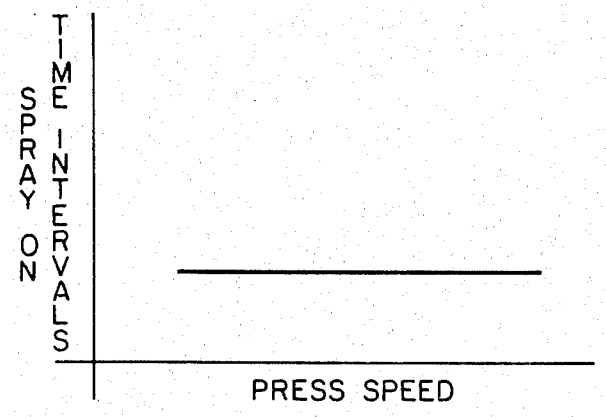
FIGS. 7A, 7B and 7C are graphs of the operating characteristics of the preferred embodiment.
Figure 7B:
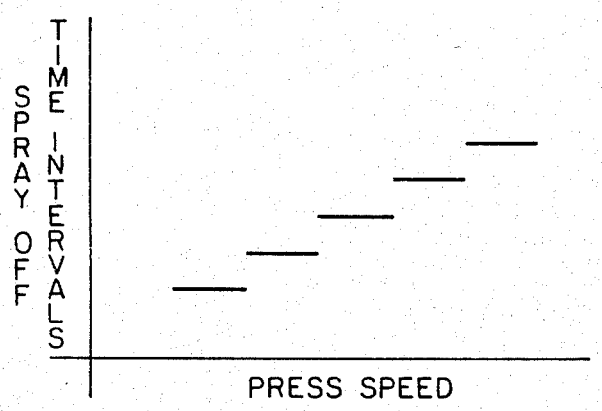
Figure 7C:
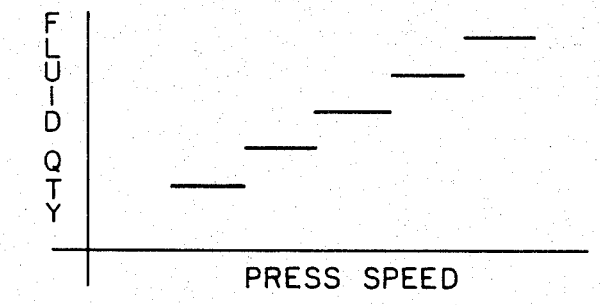

As most preferred, the controller 28 maintains the intervals A at a constant value for all operational press speeds, as in FIG. 7A. Also as most preferred, the time intervals B are varied with press speed through a series of plateaus, as in FIG. 7B.

Figure 6:
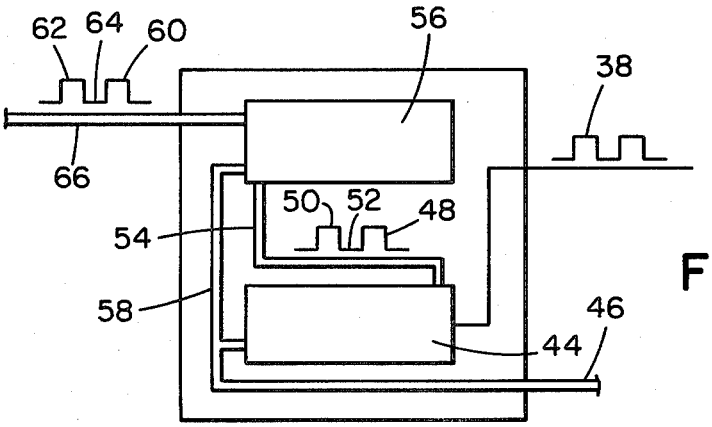
FIG. 6 is a view of the internal components of the unit controller 30 of the preferred embodiment.

The pulsed control signal 38 is directed from the programmable controller 28 to the unit controller 30. As in FIG. 6, the signal 38 is received with the controller 30 at a solenoid valve 44. The switching of the signal 38 between signal segments A and B switches the solenoid valve 44 between two states of operation. The time intervals A, B of the two operating states are determined in a one-to-one relationship by the time intervals A, B, of the segments 40, 42 respectively.

In addition to the control signal 38, the solenoid valve 44 receives a regulated, constant value air supply through tubing 46. The solenoid valve 44 has as its solenoid output signal 48 a pulsed flow of air of segments 50,52. The segments 50, 52 have time intervals A, B, respectively.

The solenoid output signal 48 is communicated by tubing 54 to an air-actuated valve 56. The valve 56 also receives a higher pressure, regulated, constant value air supply through tubing 58. The valve 56 responds to the signal 48 by generating a valve output signal 60 having segments 62, 64 of duration A, B, respectively.

The valve output signal 60 is directed to the spray bar 12 by tubing 66 and distributed to four valves 68. Each valve 68 also receives a supply of fluid to be sprayed on the roller 18. The fluid supply arrives through piping 70 from a mixing cabinet 72.

The fluid, such as water from a supply pipe 74, is combined in a mixing chamber 76 of the cabinet 72 with additives from a supply chamber 78, and pressurized in a pumping apparatus 80.

The valves 68 control the nozzles 11, and join with the nozzles 11 as part of the spraying means. In a first state of operation, each nozzle-valve combination generates a spray 82 of fluid on the roller 18. In a second state of operation, each nozzle-valve combination preferably generates no spray. The nozzle-valve combinations respond to the signal 60 by generating an intermittent or pulsed spray of pulses having a time duration A, interposed by non-spray periods of duration B. Thus, the application of fluid to the roller 18 occurs in spray pulses, with the time intervals B between pulses varied with press speed in a series of plateaus, as in FIG. 6B.

The time intervals A, B may be set as desired, within the maximum time limit fixed by the ability of the press to compensate for the time intervals between pulses. This ability is determined by nozzle pressure, roller size, press speed, etc. As an example, a newspaper press may have an operating speed range of 2500 papers/hour to 65,000 papers/hour. With an application roller of 6–9 inch diameter rotating at a speed range of 35 rpm to 900 rpm and a nozzle pressure of about 100 psi, a suitable time interval A is about 44 milliseconds. A suitable range for time interval B is 110 milliseconds to 990 milliseconds.

As the person of ordinary skill in the art will appreciate, various components of the apparatus 10 may be readily purchased for use in the apparatus 10. As most preferred, the sensor 26 is a proximity type rpm sensor; the solenoid valve 44 is a miniature extended-cycle-life valve; the valve 56 is an air piloted air valve; the valves 68 are air piloted water valves; and the nozzles 11 are equal distribution nozzles. The sensor 26 is available from Digital Systems, Inc.; the valves 44, 68 from Clippard, Inc.; and the nozzles 11 from Spraying Systems, Inc.

Also as most preferred, the apparatus 10 includes not one, but up to six spray bar assemblies 12 and 14, and an equal number of unit controllers 30, with one controller 28 and sensor 26. The nozzles 11 of the spray bar 14 are controlled independently of the bars 12, because the anti-set off fluid application requires a greater quantity of fluid. For a seven inch impression cylinder, time intervals A, B for the bar 14 are as follows: 40 msec. on; 40 msec. off.

All nozzles 11 are provided with fluid drawback valves to eliminate dripping and reduce clogging. The supply pressures of fluid and air are regulated to lower values than supply, to eliminate fluctuations due to uncontrollable supply pressure variations.

As desired, the means for controlling the spray means may comprise many types of control elements. A readily available pulse width modulator may be employed, as may relays or a microprocessor. The microprocessor is preferred, because it can also control the mixing cabinet, permit purge cycles, pre-wet cycles, and be readily adapted to the running habits of the pressroom.

What is claimed is:

1. Fluid dispensing apparatus for dispensing fluid with a fluid pressure to a plurality of rollers of a lithographic printing press comprising:

electromechanical means operatively connected to the printing press for sensing a speed of the printing press, and for generating an electrical signal related to the printing press speed;

a plurality of spray bars mounted singly in operative proximity to each of the plurality of rollers;

a plurality of nozzles each having an orifice, mounted in spaced relation along each of the spray bars, and adapted to spray the fluid toward and on each of the plurality of rollers;

a plurality of mechanical shut off valves each controlling a nozzle, and mounted on the spray bars, each nozzle and controlling valve being operable in a first state of operation for spraying the fluid and a second state of operation being a non-spraying state of shutting off the fluid;

an electronic, programmable controller means for receiving the electrical signal related to printing press speed, and for generating an electrical, pulsed control signal consisting of first control signal segments having a first control signal value and a time interval A interrupted by second control signal segments having a second control signal value and a time interval B, the pulsed control signal varying in relation to the frequency of the electrical signal related to printing press speed, the programmable controller being electrically, operatively connected to the electromechanical sensing means;

a plurality of electromechanical unit controller means each for receiving the electrical, pulsed control signal and for generating an output signal to one of the controlling valves, the output signal consisting of first output signal segments having a first output signal value and the time interval A interrupted by the second output signal segments having a second output signal value and the time interval B, the output signal corresponding in a one-to-one relationship with the pulsed control signal and thereby varying in relation to the frequency of the electrical signal related to press speed, the unit controllers each being electrically, operatively connected to the programmable controller and mechanically, operatively connected to one of the controlling valves;

each nozzle and controlling valves operating in said first state of operation during time intervals A of the first output signal segments, operating in the second state of operation during time intervals B of the second output signal segments, and switching between the first and second states of operation at the ends of the time intervals A and B, the nozzles thereby producing spray varying in relation to the frequency of the electrical signal related to press speed.

2. Spray dampener apparatus for dispensing dampener fluid with a fluid pressure to a plurality of rollers of a lithographic printing press comprising:

electromechanical means operatively connected to the printing press for sensing a speed of the printing press, and for generating an electrical signal related to the printing press speed;

a plurality of spray bars mounted singly in operative proximity to each of the plurality of rollers;

a plurality of nozzles each having an orifice, mounted in spaced relation along each of the spray bars, and adapted to spray the dampener fluid toward and on each of the plurality of rollers;

a plurality of mechanical shut off valves each controlling a nozzle, and mounted on the spray bars, each nozzle and controlling valve being operable in a first state of operation for spraying the dampener fluid and a second state of operation being a non-spraying state of shutting off the dampener fluid;

an electronic, programmable controller means for receiving the electrical signal related to printing press speed, and for generating an electrical, pulsed control signal consisting of first control signal segments having a first control signal value and a time interval A interrupted by second control signal segments having a second control signal value and a time interval B, the pulsed control signal varying in relation to the frequency of the electrical signal related to printing press speed, the programmable controller being electrically, operatively connected to the electromechanical sensing means;

a plurality of electromechanical unit controller means each for receiving the electrical, pulsed control signal and for generating an output signal to one of the controlling valves, the output signal consisting of first output signal segments having a first output signal value and the time interval A interrupted by second output signal segments having a second output signal value and the time interval B, the output signal corresponding in a one-to-one relationship with the pulsed control signal and thereby varying in relation to the frequency of the electrical signal related to press speed, the unit controllers each being electrically, operatively connected to the programmable controller and mechanically, operatively connected to one of the controlling valves;

each nozzle and controlling valves operating in said first state of operation during time intervals A of the first output signal segments, operating in the second state of operation during time intervals B of the second output signal segments, and switching between the first and second states of operation at the ends of the time intervals A and B, the nozzles thereby producing dampening fluid spray varying the relation to the frequency of the electrical signal related to press speed.

* * * * *